US012571576B2

(12) United States Patent
Chang

(10) Patent No.: US 12,571,576 B2
(45) Date of Patent: Mar. 10, 2026

(54) HOT SWAPPABLE PUMP DEVICE

(71) Applicant: ACCTON TECHNOLOGY CORPORATION, Hsinchu (TW)

(72) Inventor: Ting-Jui Chang, New Taipei City (TW)

(73) Assignee: ACCTON TECHNOLOGY CORPORATION, New Taipei City (TW)

( * ) Notice: Subject to any disclaimer, the term of this patent is extended or adjusted under 35 U.S.C. 154(b) by 120 days.

(21) Appl. No.: 18/783,442

(22) Filed: Jul. 25, 2024

(65) Prior Publication Data

US 2025/0189204 A1 Jun. 12, 2025

(30) Foreign Application Priority Data

Dec. 11, 2023 (CN) ..... 202323369964.7

(51) Int. Cl.
*F25D 17/02* (2006.01)

(52) U.S. Cl.
CPC ..... *F25D 17/02* (2013.01)

(58) Field of Classification Search
CPC ..... H05K 7/20263; H05K 7/20272; F25D 17/02; F25D 17/00
USPC ..... 165/104.33; 417/540
See application file for complete search history.

(56) References Cited

U.S. PATENT DOCUMENTS 4,123,618 A * 10/1978 Cushing ..... H01H 33/68 174/209
5,738,498 A * 4/1998 Allington ..... B01D 11/0407 417/372
10,893,630 B2 * 1/2021 Lunsman ..... H05K 7/20272
11,363,738 B2 * 6/2022 Thompson ..... H05K 7/20272
11,644,018 B2 * 5/2023 Thomas ..... F04B 53/007 417/567
11,882,678 B2 * 1/2024 Miyamura ..... H05K 7/20818
12,127,373 B2 * 10/2024 Field ..... H05K 7/20772
12,324,131 B2 * 6/2025 Amalfi ..... H05K 7/20318
2002/0176788 A1 * 11/2002 Moutafis ..... A61B 17/3203 417/415
2011/0100328 A1 * 5/2011 Paul ..... H01M 8/186 174/138 R
2012/0216894 A1 * 8/2012 Lomax ..... F16K 27/067 251/315.1
2014/0093411 A1 * 4/2014 Harwood ..... F04B 9/04 92/138
2014/0119958 A1 * 5/2014 Dane ..... F04D 29/648 417/321

(Continued)

*Primary Examiner* — Claire E Rojohn, III
(74) *Attorney, Agent, or Firm* — Apex Juris, pllc; Cera Oh

(57) ABSTRACT

A hot swappable pump device includes an outer cover and a plurality of fastening holes disposed on a periphery of the outer cover. A peripheral edge of one end of each fastening hole has a first positioning surface. A floating plate of a pump support abuts against the outer cover. A pump with two quick plugs is combined with the pump support. The floating plate has a plurality of through holes, wherein a peripheral edge of one end of each through hole has a first limiting surface. A plurality of positioning members floatingly pass through the through holes respectively, wherein one end of each positioning member is combined with each fastening hole. Each positioning member has a second positioning surface abutting against the first limiting surface and a second limiting surface adjacent to the first limiting surface.

10 Claims, 12 Drawing Sheets

(56) References Cited

U.S. PATENT DOCUMENTS

| | | | | |
|---|---|---|---|---|
| 2016/0128238 | A1* | 5/2016 | Shedd | F25B 41/42<br>361/679.47 |
| 2017/0027085 | A1* | 1/2017 | Held | H05K 7/20727 |
| 2018/0063993 | A1* | 3/2018 | Wu | G06F 1/20 |
| 2025/0008688 | A1* | 1/2025 | Djuranec | H05K 7/20263 |

* cited by examiner

HOT SWAPPABLE PUMP DEVICE

BACKGROUND OF THE INVENTION

Technical Field

The present disclosure relates generally to a pump of a water cooling system, and more particularly to a hot swappable pump device.

Description of Related Art

An existing housing has a water cooling system inside to cool an electronic device. The water cooling system includes a pump adapted to drive a cooling fluid inside the water cooling system to flow. To enhance the lifespan of the water cooling system, the pump is designed as a hot swappable device. This prevents the need to disassemble the entire housing in case the pump in the housing fails, enabling maintenance of the pump of the water cooling system without prolonged downtime of the housing.

However, when the housing is provided with a slot and a quick socket of the water cooling system inside the housing and a quick plug of a hot swappable pump module is connected to the quick socket, there could be a misalignment between the slot of the housing and the quick plug due to dimensional tolerances. As a result, an outer cover could not be smoothly inserted into the slot of the housing when the pump of the hot swappable pump module is connected to the water cooling system inside the housing.

BRIEF SUMMARY OF THE INVENTION

In view of the above, the primary objective of the present disclosure is to provide a hot swappable pump device that includes a component between a pump and an outer cover. The component allows the outer cover to adjust a position of the outer cover relative to the pump in a floating manner. When the pump is inserted into a slot of a housing to connect to a water cooling system inside the housing, the position of the outer cover relative to the pump could be adjusted even if a misalignment between the outer cover and the slot is resulted due to dimensional tolerances, so that the outer cover could be smoothly inserted into the slot for fixing.

The present disclosure provides a hot swappable pump device, including an outer cover, a pump support, at least two positioning members, and a pump. The outer cover has an inner surface, wherein a normal direction of the inner surface is defined as an insertion direction. At least two fastening holes are disposed on a periphery of the inner surface, wherein a peripheral edge of an end of each of the at least two fastening holes facing the insertion direction has a first positioning surface. The pump support includes a floating plate and a pump base connected to the floating plate, wherein the floating plate abuts against the inner surface of the outer cover. The floating plate is provided with at least two through holes corresponding to the at least two fastening holes. A peripheral edge of an end of each of the at least two through holes facing the insertion direction has a first limiting surface.

Each of the at least two positioning members has a rod, a second positioning surface, and a second limiting surface in sequence along the insertion direction, wherein each of the at least two positioning members passes through each of the at least two through holes and is combined with each of the at least two fastening holes with the rod. The second positioning surface abuts against the first positioning surface, and the second limiting surface is adjacent to the first limiting surface. A diameter of a part of each of the at least two positioning members located between the second positioning surface and the second limiting surface is smaller than a diameter of each of the at least two through holes. The pump is combined with the pump base of the pump support, wherein one side of the pump facing the insertion direction has two quick plugs.

Preferably, the pump base of the present disclosure includes a rear plate and a supporting plate connected to the rear plate, wherein the rear plate is combined with the floating plate, and the pump is combined with the supporting plate. Alternatively, the pump base might be a plate and is integrally connected to the floating plate.

Preferably, each of the at least two fastening holes of the present disclosure is a screw hole. The rod of each of the at least two positioning members is a threaded rod and is screwed into each of the at least two fastening holes. At least one of the at least two positioning members includes a bolt and a collar. The bolt includes the rod and, in sequence along the insertion direction starting from the rod, a shank and a head that are sequentially connected. The colla sleeves the shank of the bolt. An outer diameter of the collar is smaller than the diameter of each of the at least two through holes. The collar has a flange around a portion of the collar adjacent to the head, wherein the flange abuts against the head. The second positioning surface is disposed on an end edge of the collar adjacent to the rod, and the second limiting surface is formed on one side of the flange opposite to the insertion direction.

Preferably, the inner surface of the present disclosure is a rectangular plane with four corners, wherein the at least two fastening holes are respectively disposed on at least two of the four corners of the inner surface, and the floating plate abuts against a middle of the inner surface. The floating plate is a rectangular plate with four corner sections around the floating plate. One side of at least one of the four corner sections facing the insertion direction forms a recess in correspondence to the number of the collar. A sidewall is provided around the recess, and one of the at least two through holes that is corresponding penetrates the recess. The flange of the collar is accommodated within the recess, and a space is disposed between the flange and the sidewall.

Preferably, the floating plate of the present disclosure has a peripheral surface, wherein one side of the recess adjacent to the peripheral surface has an opening. Two opposite sides of the peripheral surface adjacent to the opening have two elastic sheet seats. Two elastic sheets are respectively combined with the two elastic sheet seats, wherein two free ends of the two elastic sheets extend toward the opening and contact two sides of the flange.

Preferably, each of the at least two fastening holes of the present disclosure is a screw hole, and the rod of each of the at least two positioning members is a threaded rod and is screwed into each of the at least two fastening holes. At least one of the at least two positioning members is a bolt and includes the rod and, in sequence along the insertion direction starting from the rod, a shank and a head that are sequentially connected. A diameter of the shank is smaller than the diameter of each of the at least two through holes and larger than a diameter of the rod, and a diameter of the head is larger than the diameter of the shank. The second positioning surface is disposed on an end edge of the shank adjacent to the rod, and the second limiting surface is formed on one side of the head opposite to the insertion direction.

Preferably, a side of the outer cover opposite to the inner surface of the present disclosure has an outer surface, and a handle is combined with the outer surface.

The advantage of the present disclosure is that the floating plate of the pump support is restricted by the second limiting surfaces of the positioning members from moving relative to the outer cover along the insertion direction. Since the diameter of the part of each positioning member located between the second positioning surface and the second limiting surface is smaller than the diameter of each through hole of the floating plate, the floating plate included the through holes could move slightly and freely relative to the outer cover in multiple directions perpendicular to the insertion direction. In other words, the outer cover could also move slightly and freely relative to the floating plate in multiple directions perpendicular to the insertion direction.

Accordingly, the hot swappable pump device is inserted into the connector of the housing, and the two quick plugs of the pump are aligned and inserted into the two quick sockets of the water cooling system inside the housing for positioning. Afterwards, even if a position of the slot of the housing does not align with a position of the outer cover, the position of the outer cover relative to the pump, which is already fixed to the quick sockets, is adaptively adjusted with the design that allows the outer cover to move relative to the floating plate. In this way, the outer cover could be inserted into the slot of the housing by changing the position of the outer cover, thus avoiding a situation where the outer cover could not be inserted into the slot of the housing.

BRIEF DESCRIPTION OF THE SEVERAL VIEWS OF THE DRAWINGS

The present disclosure would be best understood by referring to the following detailed description of some illustrative embodiments in conjunction with the accompanying drawings, in which.

DETAILED DESCRIPTION OF THE INVENTION

Figure 1:
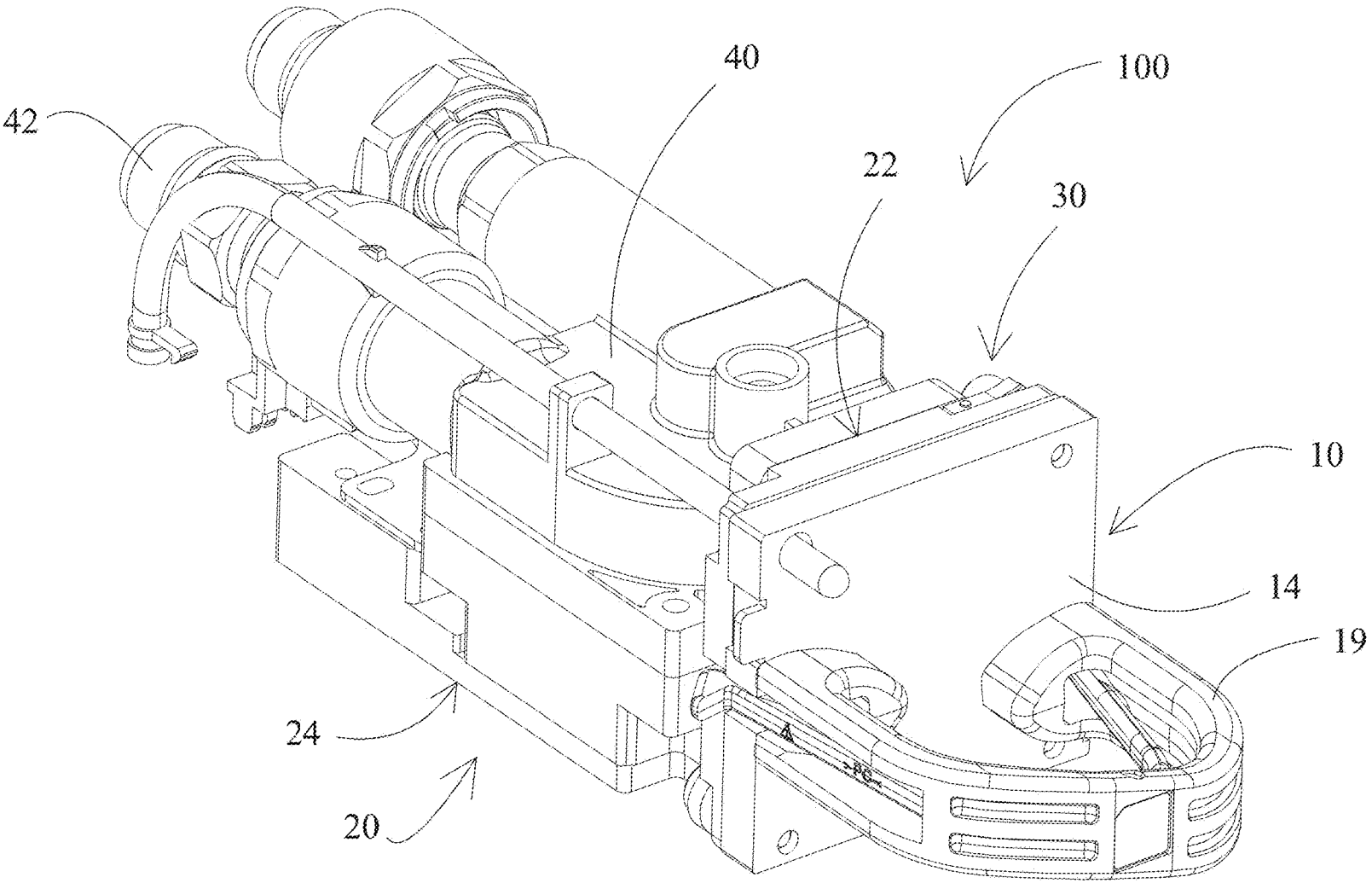
FIG. 1 is a perspective view of the hot swappable pump device according to a first embodiment of the present disclosure.

A hot swappable pump device 100 according to a first embodiment of the present disclosure is illustrated in FIG. 1 to FIG. 4 and includes an outer cover 10, a pump support 20 floatingly disposed on the outer cover 10, three positioning members 30 respectively combined between the outer cover 10 and the pump support 20, and a pump 40 combined with the pump support 20.

The outer cover 10 is a rectangular plate with an inner surface 12 and an outer surface 14 located on a side opposite to the inner surface 12. A normal direction of the inner surface 12 is defined as an insertion direction D. In the current embodiment, the inner surface 12 is a rectangular plane with four corners 121 on a periphery of the inner surface 12. Three of the four corners 121, each have a fastening hole 16. Specifically, each fastening hole 16 is a screw hole, wherein a peripheral edge of an end of each fastening hole 16 facing the insertion direction D has a first positioning surface 18. To allow a user to more conveniently drag the outer cover 10 by hand, a handle 19 is combined with a middle of the outer surface 14. In other embodiments, the outer surface 14 could be provided without the handle 19.

The pump support 20 includes a floating plate 22 and a pump base 24 connected to the floating plate 22. The floating plate 22 is a rectangular plate abutting against a middle of the inner surface 12 of the outer cover 10. The floating plate 22 has a peripheral surface 221 and four corner sections A around the floating plate 22. In the current embodiment, a side of each corner section A facing the insertion direction D forms a recess 222. A sidewall 2221 is provided around the recess 222, and one side of each recess 222 adjacent to the peripheral surface 221 has an opening 2223. Two opposite sides of the peripheral surface 221, which are adjacent to the opening 2223 of one of the recesses 222, have two elastic sheet seats 223, and two elastic sheets 224 are respectively combined with the two elastic sheet seats 223. A free end of each of the two elastic sheets 224 extends towards the opening 2223. In other embodiments, the two elastic sheet seats 223 and the two elastic sheets 224 around the recess 222 could be omitted.

The floating plate 22 is provided with a plurality of through holes 26 corresponding to positions of the three fastening holes 16, so that a position of each through hole 26 directly corresponds to the position of each fastening hole 16. Each through hole 26 penetrates each recess 222, and a peripheral edge of an end of each through hole 26 facing the insertion direction D has a first limiting surface 28; specifically, each first limiting surface 28 is adjacent to each recess 222. In the current embodiment, the pump base 24 is an L-shaped plate and includes a rear plate 241 and a supporting plate 242 connected to the rear plate 241. The rear plate 241 contacts and is screwed to a middle part of the floating plate 22 where the recesses 222 are not formed. In the first embodiment, the pump support 20 includes the floating plate 22 and the pump base 24. In other embodiments, the pump base could be a single plate and integrally connected to the floating plate 22, making the pump support 20 become a one-piece L-shaped plate; the pump base in plate form is provided for being combined with the pump 40.

Referring to FIG. 5 to FIG. 8, the three positioning members 30 respectively pass through the through holes 26. In the current embodiment, each positioning member 30 includes a bolt 32 and a collar 34. The bolt 32 includes a rod 321 and, in sequence along the insertion direction D from the rod 321, a shank 322 and a head 323 sequentially connected. The rod 321 is a threaded rod and is screwed into one of the fastening holes 16. An end of the shank 322 facing the insertion direction D passes out of the through hole 26, so that the head 323 is located outside the recess 222. A diameter of the head 323 is larger than a diameter of the shank 322. The collar 34 is fitted onto the shank 322 of the bolt 32 in a size-matching manner, wherein an outer diameter H1 of the collar 34 is smaller than a diameter H2 of the through hole 26. The collar 34 has a flange 341 around a portion of the collar 34 adjacent to the head 323, wherein an outer diameter of the flange 341 is larger than an outer diameter of other portions of the collar 34.

The flange 341 of the collar 34 abuts against the head 323 and is accommodated within the recess 222. A space B is disposed between the flange 341 and the sidewall 2221 of the recess 222. A second positioning surface 36 is disposed on an end edge of the collar 34 adjacent to the rod 321, and a second limiting surface 38 is disposed on one side of the flange 341 opposite to the insertion direction D. The second positioning surface 36 of the collar 34 abuts against the first positioning surface 18 of the outer cover 10 for positioning. The second limiting surface 38 is adjacent to the first limiting surface 28 on the floating plate 22, which means the second limiting surface 38 is very close to, or lightly contacts, the first limiting surface 28 on the floating plate 22. A support provided by the collar 34 limits a depth to which the rod 321 of the bolt 32 could be screwed into the fastening hole 16, and fixes a distance between the head 323 and the outer cover 10 along the insertion direction D. The two free ends of the two elastic sheets 224 contact two sides of the flange 341 of the corresponding positioning member 30. Specifically, the contact points of the two elastic sheets 224 with the flange 341 are on two opposite sides to the space B.

Overall, each positioning member 30 sequentially includes the rod 321, the second positioning surface 36, and the second limiting surface 38 along the insertion direction D. A middle part of each positioning member 30 passes through the respective through hole 26 and the positioning member 30 is combined with the fastening hole 16 with the rod 321. The second positioning surface 36 of each positioning member 30 abuts against the first positioning surface 18 of the outer cover 10, and the second limiting surface 38 of each positioning member 30 is adjacent to the first limiting surface 28. A diameter of a part of each positioning member 30 between the second positioning surface 36 and the second limiting surface 38, which is the outer diameter H1 of each collar 34, is smaller than the diameter H2 of each through hole 26. In this way, the floating plate 22 having the through holes 26 could move freely relative to the outer cover 10 in multiple directions, which are perpendicular to the insertion direction D, within a range of a space between the outer diameter H1 of each collar 34 and the diameter H2 of each through hole 26, or within a range of the space B between the flange 341 and the sidewall 2221 of the recess 222, depending on which range of the space limitation is met first.

In other words, the outer cover 10 could also move freely relative to the outer cover 10 in multiple directions, which are perpendicular to the insertion direction D, within the range of the space between the outer diameter H1 of each collar 34 and the diameter H2 of each through hole 26, or within the range of the space B between the flange 341 and the sidewall 2221 of the recess 222. Moreover, by the design of the two elastic sheets 224 disposed on the floating plate 22 to contact the two sides of one of the flanges 341, when the floating plate 22 is pushed by an external force to deform any one of the elastic sheets 224, the floating plate 22 would be pushed back to an original position upon release by a restoring force of the two elastic sheets 224.

The pump 40 is combined with the pump base 24 of the pump support 20. Specifically, the pump 40 is combined with the supporting plate 242 of the pump support 20. One side of the pump 40 facing the insertion direction D has two quick plugs 42, wherein one of the two quick plugs 42 is used to introduce a fluid into the pump 40, and the other quick plug 42 is used to output the fluid from the pump 40.

Figure 2:
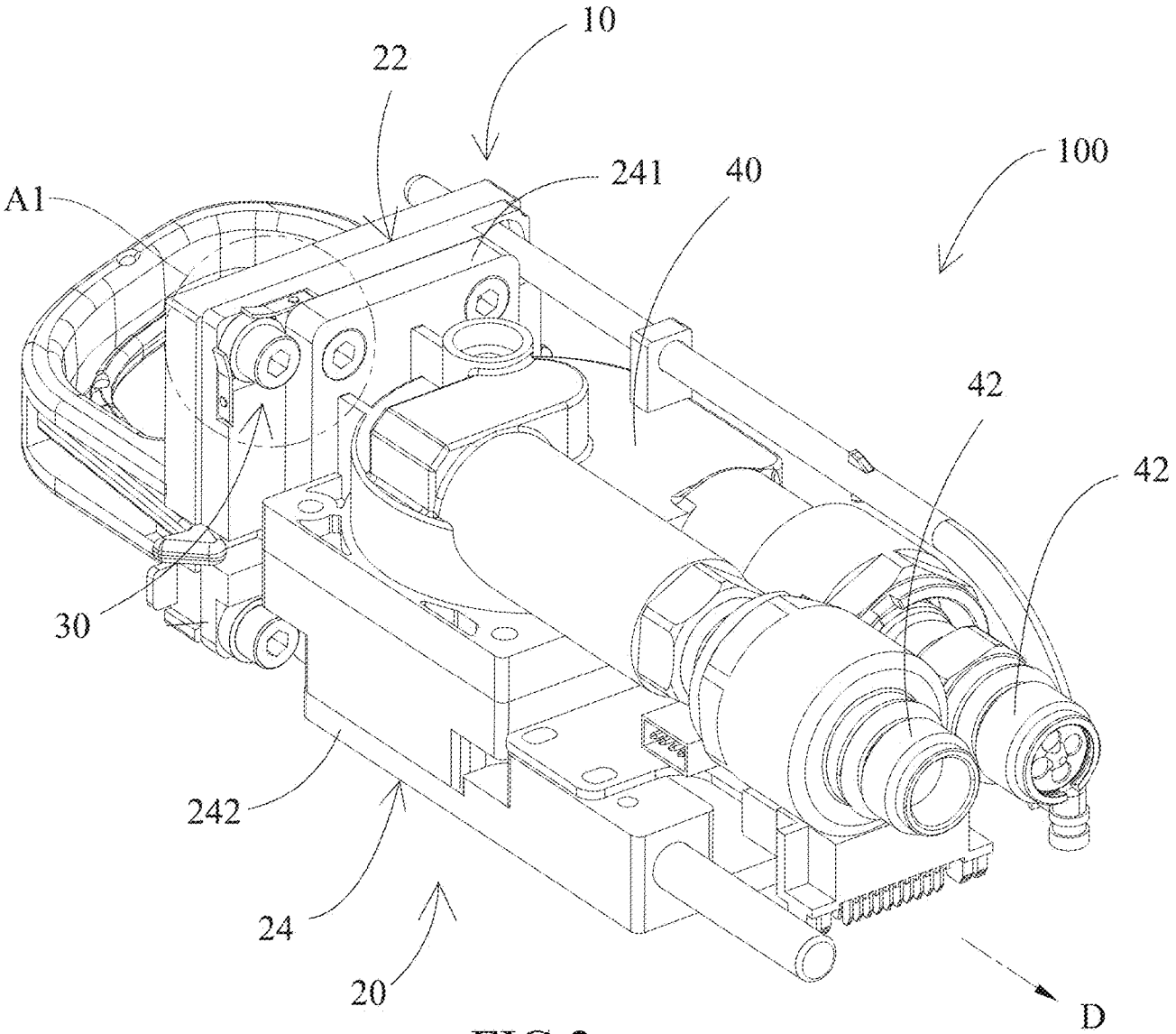
FIG. 2 is a perspective view of the hot swappable pump device according to the first embodiment of the present disclosure seen from another direction.
Figure 3:
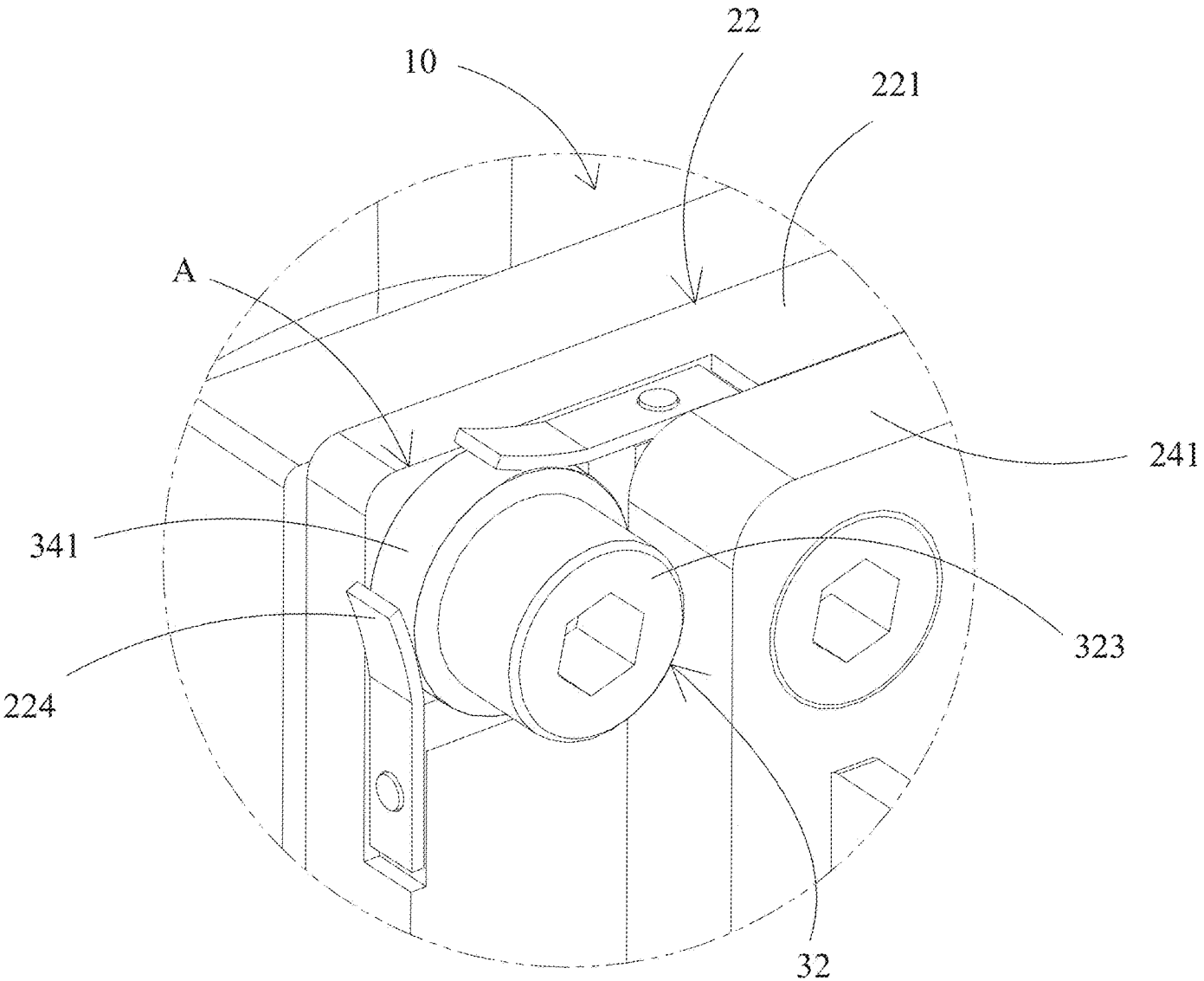
FIG. 3 is an enlarged view of a marked region A1 in FIG. 2.
Figure 4:
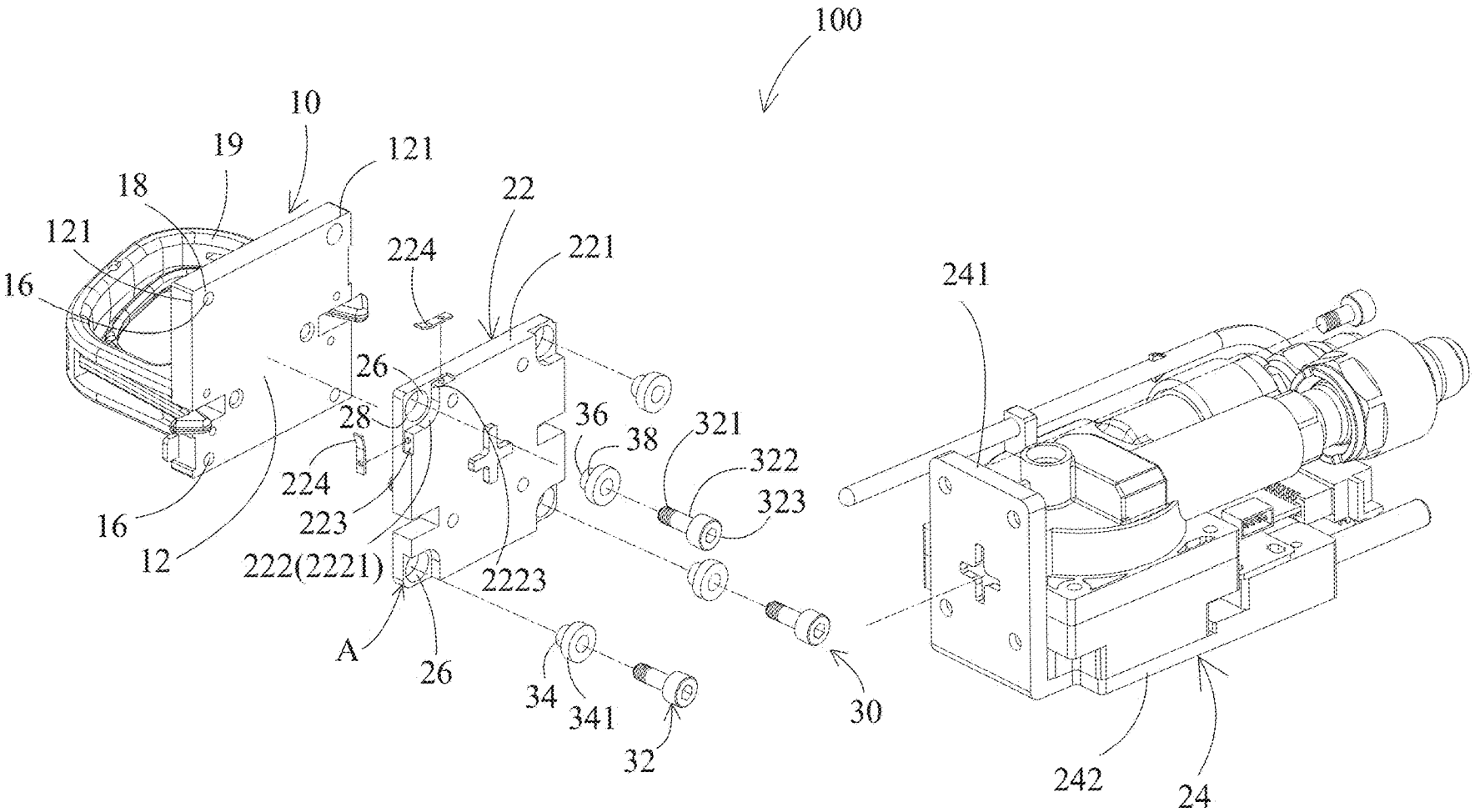
FIG. 4 is an exploded view of the hot swappable pump device according to the first embodiment of the present disclosure.
Figure 5:
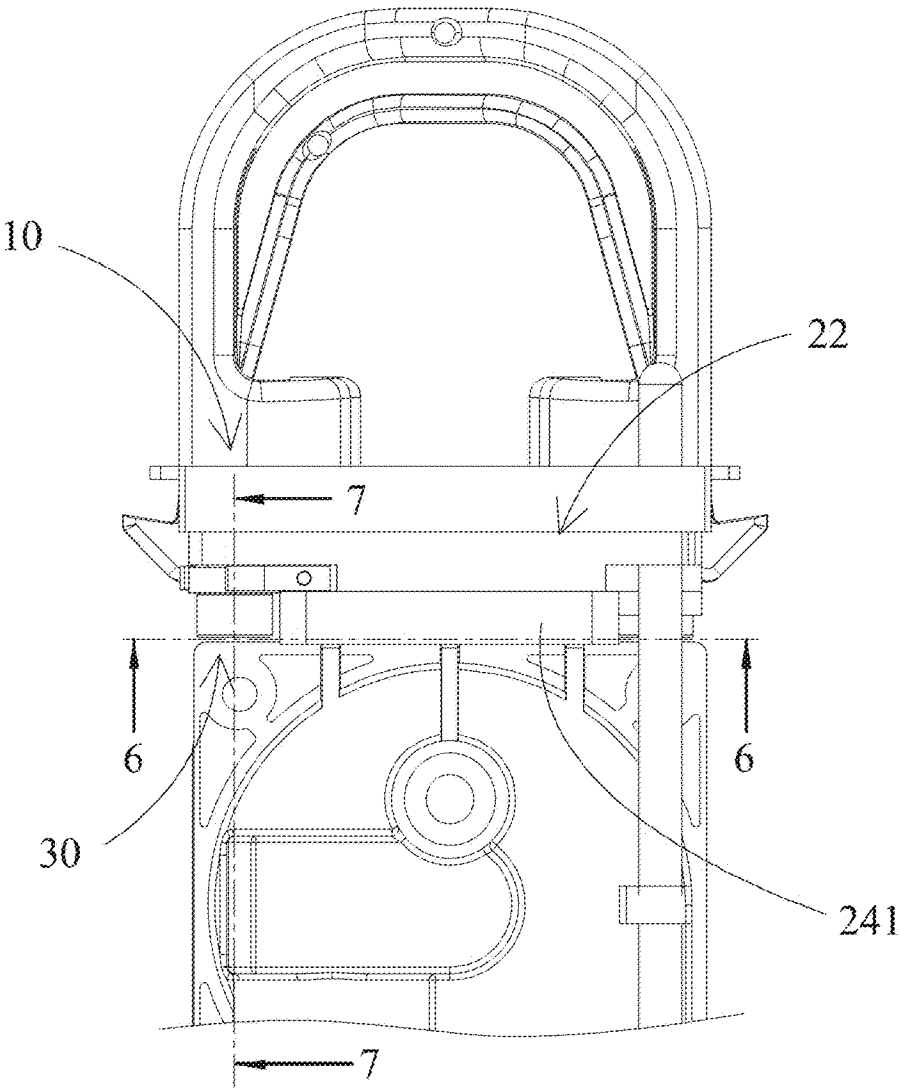
FIG. 5 is a partial top view of the hot swappable pump device according to the first embodiment of the present disclosure.
Figure 6:
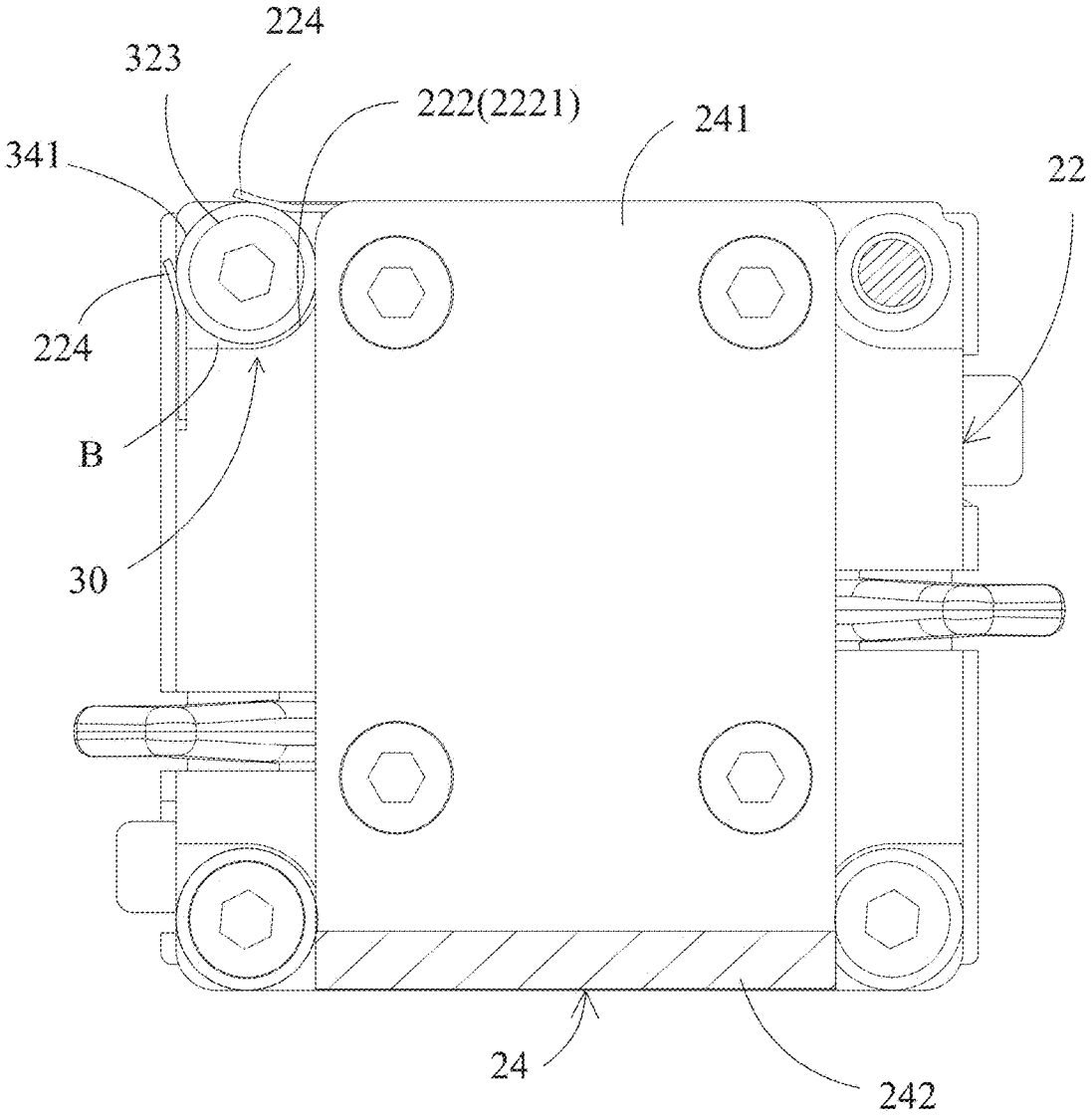
FIG. 6 is a sectional view along the 6-6 line in FIG. 5.
Figure 7:
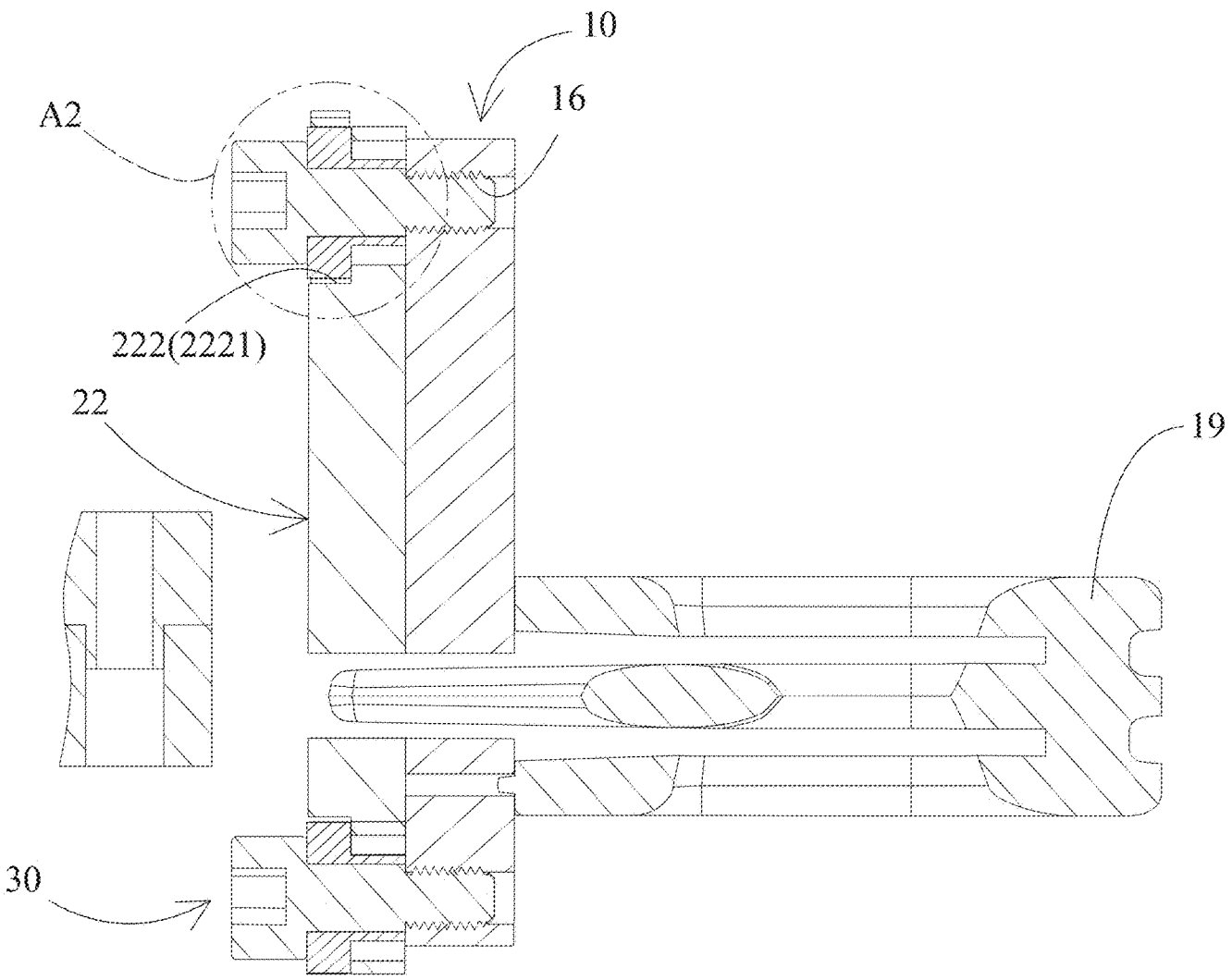
FIG. 7 is a sectional view along the 7-7 line in FIG. 5.
Figure 8:
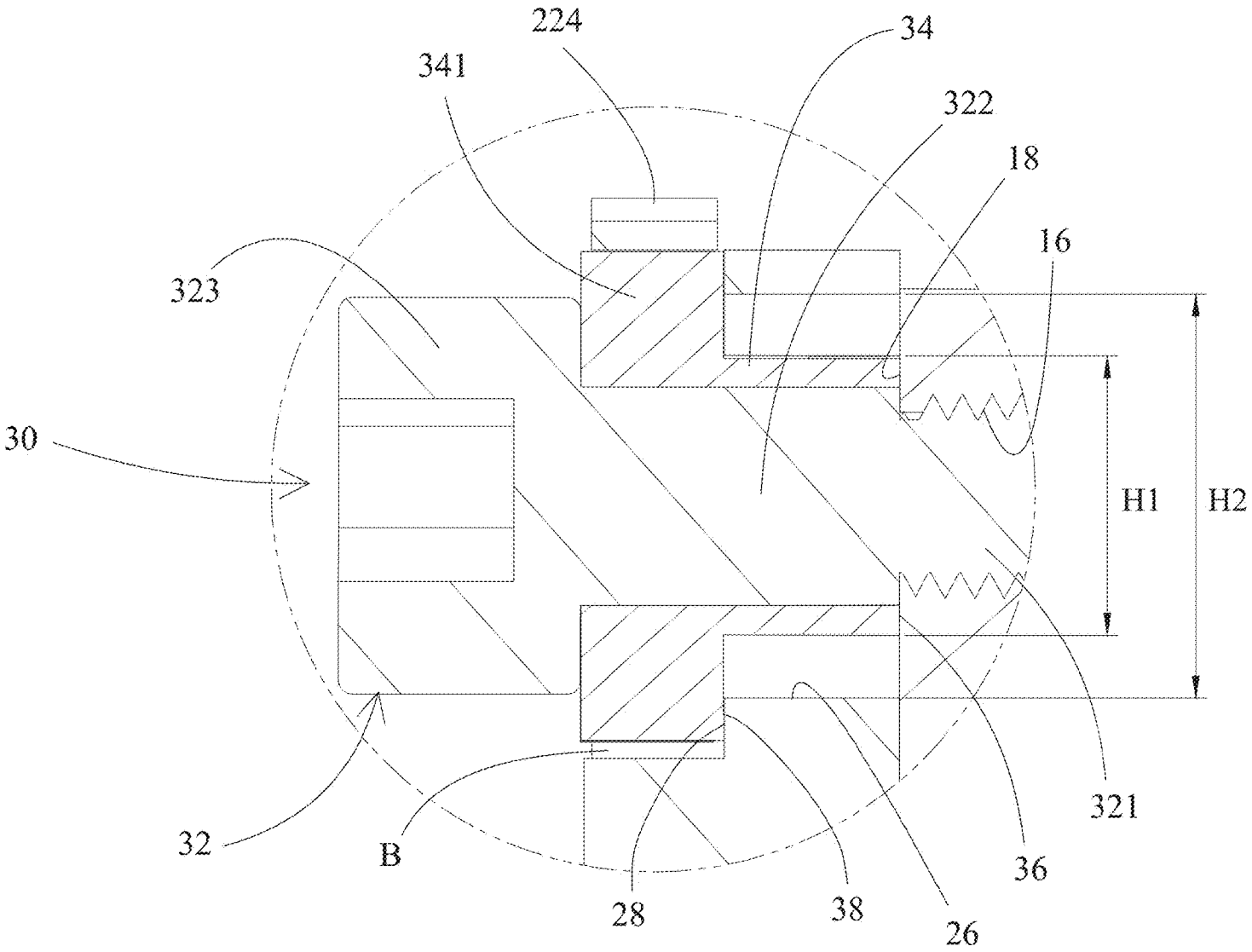
FIG. 8 is an enlarged view of a marked region A2 in FIG. 7.
Figure 9:
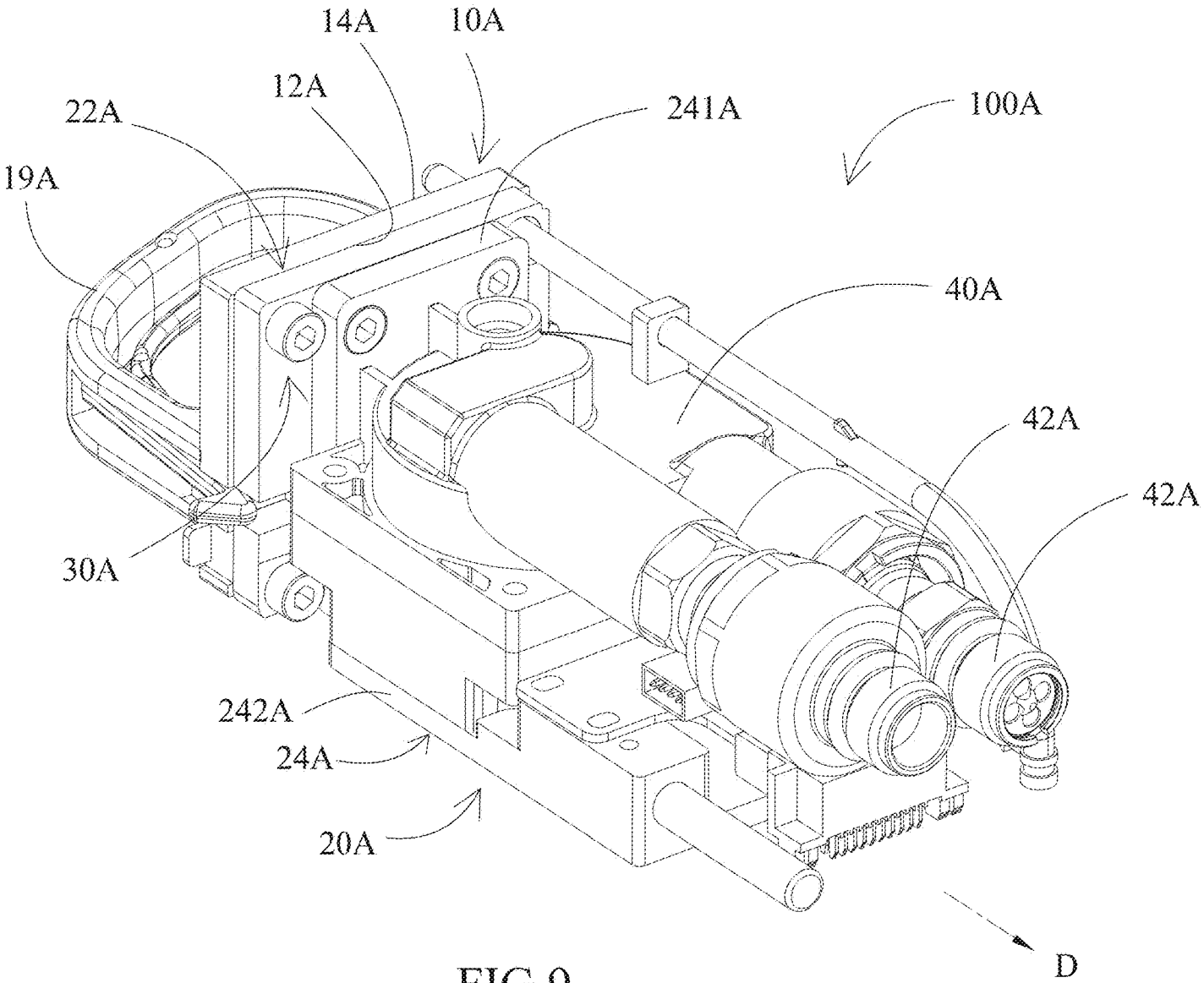
FIG. 9 is a perspective view of the hot swappable pump device according to a second embodiment of the present disclosure.
Figure 10:
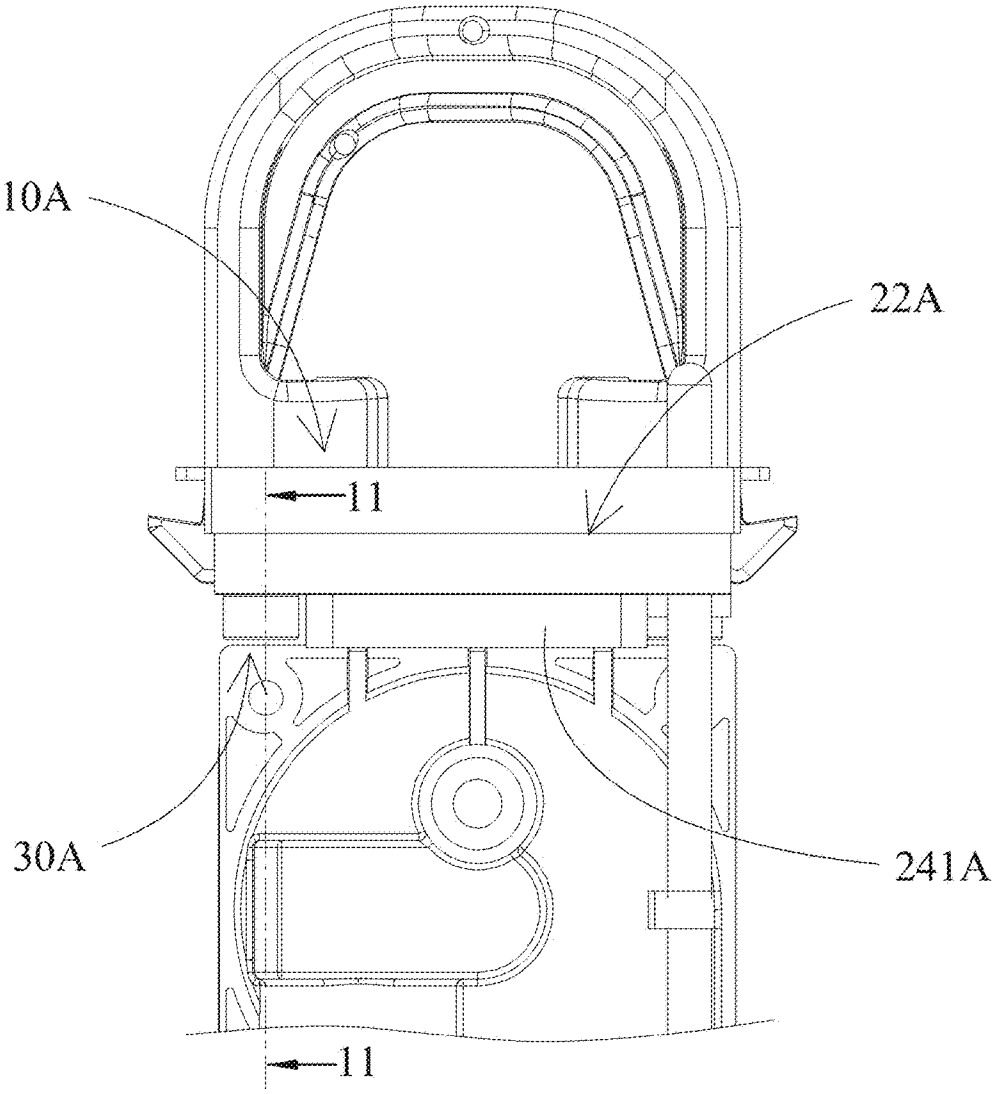
FIG. 10 is a partial top view of the hot swappable pump device according to the second embodiment of the present disclosure.
Figure 11:
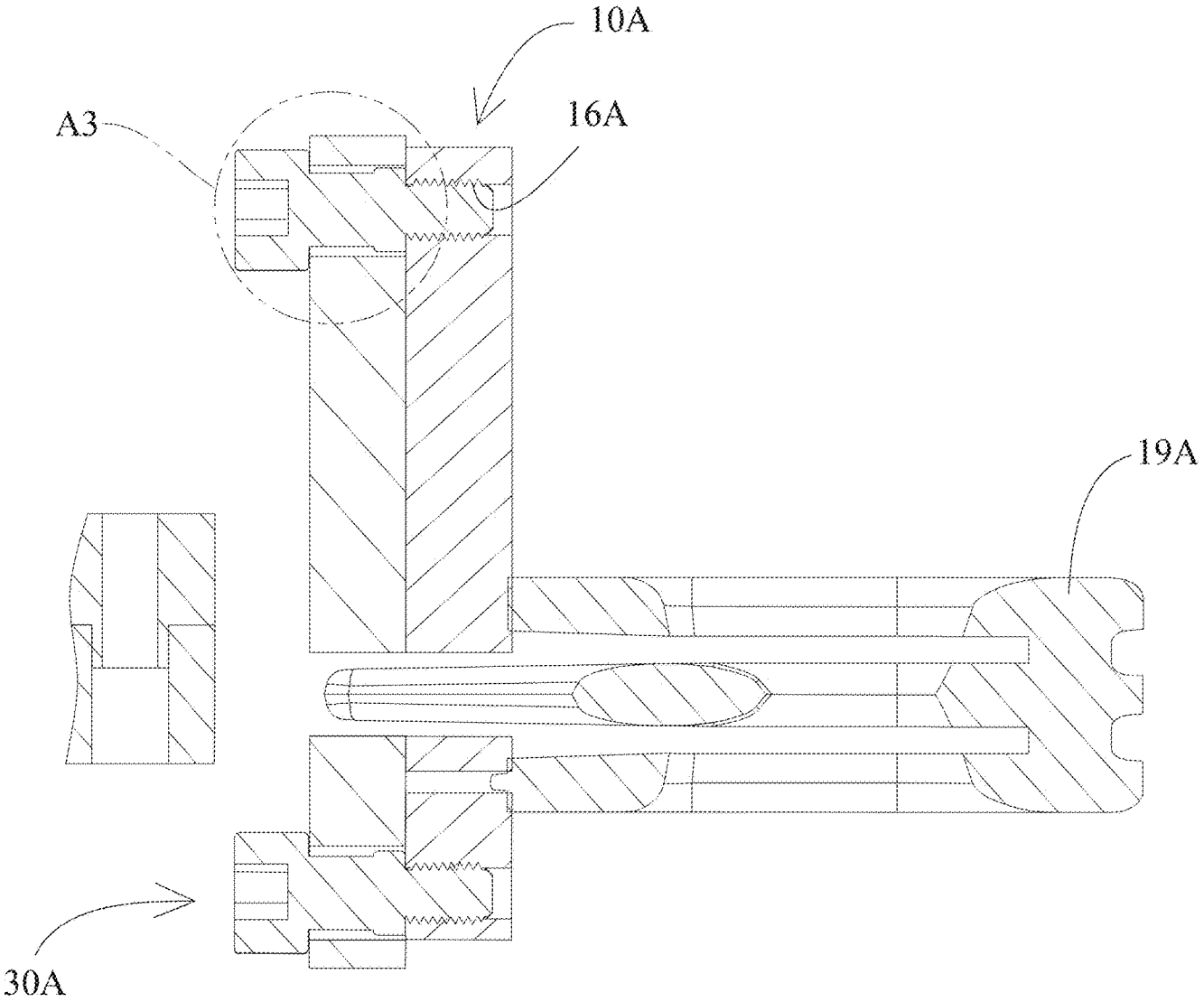
FIG. 11 is a sectional view along the 11-11 line in FIG. 10.
Figure 12:
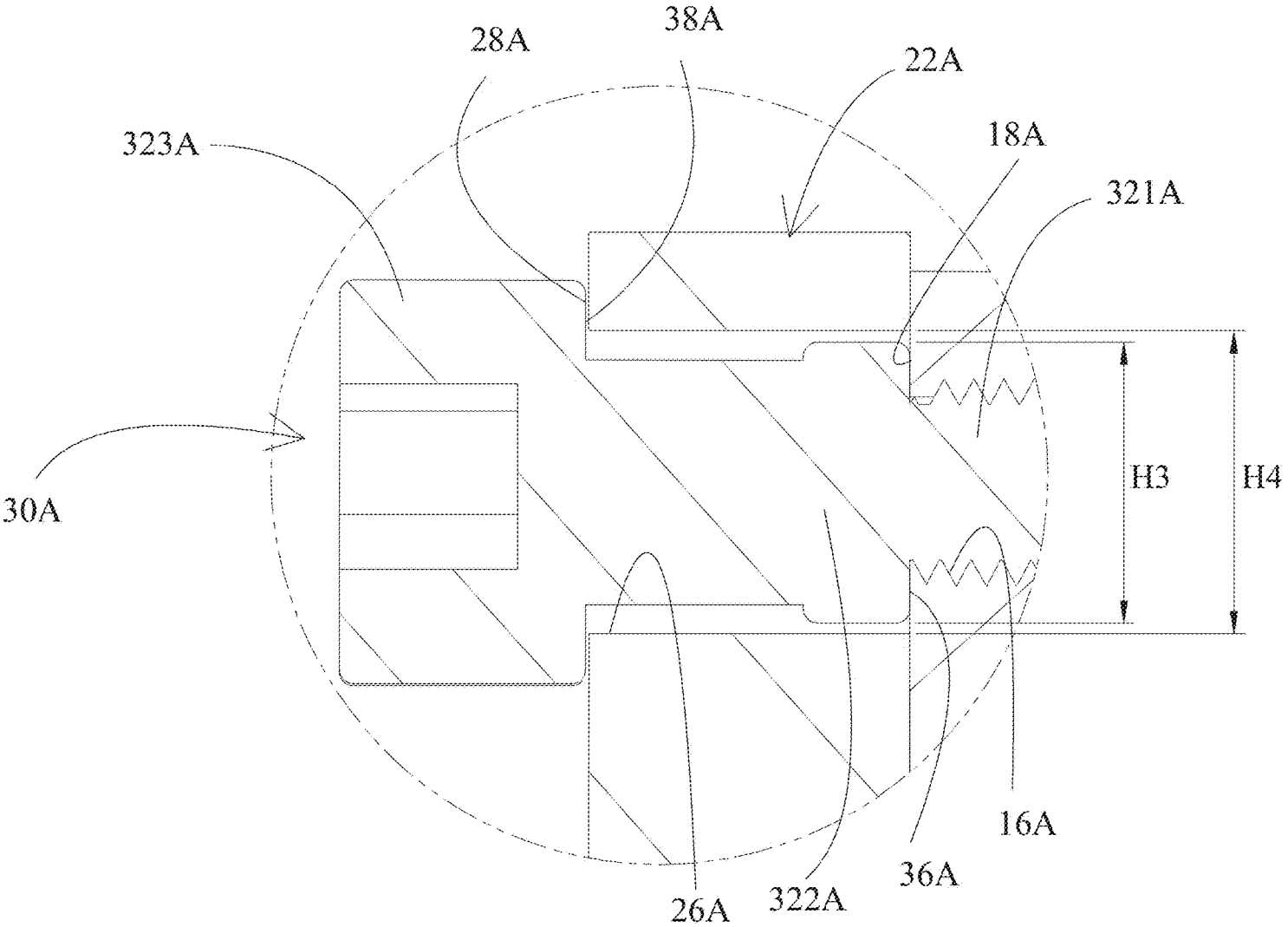
FIG. 12 is an enlarged view of a marked region A3 in FIG. 11.

Referring to FIG. 1 to FIG. 2, when the first embodiment of the present disclosure is used, the user holds the handle 19 on the outer cover 10 and inserts the hot swappable pump device 100 into a slot of a housing. The two quick plugs 42 of the pump 40 are aligned with a quick socket of a water cooling system inside the housing. The two quick plugs 42 are inserted into the quick socket of the water cooling system along the insertion direction D, concatenating the pump 40 to the water cooling system inside the housing to drive a liquid within the water cooling system to flow. When the two quick plugs 42 of the pump 40 are inserted into the quick socket of the water cooling system inside the housing, a position of the pump 40, a position of the pump support 20, and a position of the outer cover 10 are determined by a position of the quick socket.

Therefore, when a relative position between the slot of the housing, into which the hot swappable pump device 100 is inserted, and the quick socket inside the housing does not match with a relative position between the two quick plugs 42 of the hot swappable pump device 100 and the outer cover 10, the outer cover 10 is misaligned with the slot of the housing after the two quick plugs 42 of the pump 40 are inserted into the quick socket. This misalignment prevents the outer cover 10 from being smoothly inserted into the slot. However, in the first embodiment of the present disclosure, since the outer cover 10 could move relative to the floating plate 22, the position of the outer cover 10 relative to the pump 40 could be adjusted. This adjustment allows the outer cover 10 to move adaptively and smoothly insert into the slot of the housing, preventing a situation where the outer cover 10 could not be placed into the slot of the housing.

In the first embodiment of the present disclosure, three fastening holes 16 are disposed at the outer cover 10, three through holes 26 are disposed at the floating plate 22 in correspondence to the positions of the three fastening holes 16, and three positioning members 30 are disposed in correspondence to the three fastening holes 16 and the three through holes 26. In other embodiments, either two or four fastening holes 16 could be disposed around the outer cover 10, two or four through holes 26, which correspond to positions of the two fastening holes 16 or positions of the four fastening holes 16, are disposed at the floating plate 22, and two or four positioning members 30 are disposed to correspond to the number of the fastening holes 16 and the number of the through holes 26; a way of passing each positioning member 30 through each through hole 26 and combining each positioning member 30 with each fastening hole 16 is the same as the positioning member 30 described in the first embodiment. In the first embodiment, each positioning member 30 is equipped with the bolt 32 for disposing the collar 34 and is screwed into each fastening hole 16 with the rod 321. In other embodiments, a pin with a head could replace the bolt 32; the pin also has a rod, a shank, and the head that are sequentially connected; the rod of the pin is inserted into a fastening hole, which is a straight hole, in a tight-fitting manner for fixation, and the collar 34 sleeves the shank of the pin, thereby achieving the same effect that the collar 34 of the positioning member 30 is disposed on the pin.

In the first embodiment of the present disclosure, each of the three positioning members 30 includes the bolt 32 and the collar 34 sleeving the bolt 32. In a second embodiment as illustrated in FIG. 9 to FIG. 12, each of a plurality of positioning members 30A could be provided as an integrated structure. A hot swappable pump device 100A of the second embodiment includes an outer cover 10A, a pump support 20A floatingly disposed on the outer cover 10A, three positioning members 30A respectively combined between the outer cover 10A and the pump support 20A, and a pump 40A combined with the pump support 20A.

The outer cover 10A is a rectangular plate with an inner surface 12A and an outer surface 14A located on a side opposite to the inner surface 12A. A normal direction of the inner surface 12A is defined as an insertion direction D. The inner surface 12A is a rectangular plane with four corners on a periphery of the inner surface 12A. Three of the four corners, each have a fastening hole 16A. Each fastening hole 16A is a screw hole, wherein a peripheral edge of an end of each fastening hole 16A facing the insertion direction D has a first positioning surface 18A. To allow a user to more conveniently drag the outer cover 10A by hand, a handle 19A is combined with a middle of the outer surface 14A.

The pump support 20A includes a floating plate 22A and a pump base 24A connected to the floating plate 22A. The floating plate 22A is a rectangular plate abutting against on a middle of the inner surface 12A of the outer cover 10A. Three through holes 26A passing through the floating plate 22 are respectively disposed on the floating plate 22 in correspondence to positions of the three fastening holes 16A, so that the position of each through hole 26A directly correspond to the position of each fastening hole 16A. A peripheral edge of an end of each through hole 26A facing the insertion direction D has a first limiting surface 28A. The pump base 24A includes a rear plate 241A and a supporting plate 242A connected to the rear plate 241A. The rear plate 241A contacts and is screwed to a middle part of the floating plate 22A where the through holes 26A are not formed. In other embodiments, the pump base could be a single plate and integrally connected to the floating plate 22A, making the pump support 20A become a one-piece L-shaped plate.

The three positioning members 30A respectively pass through the through holes 26A. In the current embodiment, each positioning member 30A is a bolt and includes a rod 321A and, in sequence along the insertion direction D from the rod 321A, a shank 322A and a head 323A sequentially connected. The rod 321A is a threaded rod and is screwed into one of the fastening holes 16A. A diameter H3 of the shank 322A is larger than a diameter of the rod 321A and is smaller than a diameter H4 of the through hole 26A. A diameter of the head 323A is larger than both the diameter H3 of the shank 322A and the diameter H4 of the through hole 26A. A second positioning surface 36A is disposed on an end edge of the shank 322A adjacent to the rod 321A, and a second limiting surface 38A is disposed on one side of the head 323A opposite to the insertion direction D. The shank 322A is located between the second positioning surface 36A and the second limiting surface 38A. The second positioning surface 36A of the positioning member 30A abuts against the first positioning surface 18A of the outer cover 10A for positioning. The second limiting surface 38A is adjacent to the first limiting surface 28A on the floating plate 22A, which means the second limiting surface 38A is very close to, or lightly contacts, the first limiting surface 28A on the floating plate 22A. By the second positioning surface 36A abutting against the first positioning surface 18A, a depth to which the rod 321A of the positioning member 30A could be screwed into the fastening hole 16A is limited, so that the second limiting surface 38A of the head 323A maintains a regular interval away from the first limiting surface 28A of the floating plate 22A.

Overall, each positioning member 30A sequentially includes the rod 321A, the second positioning surface 36A, and the second limiting surface 38A along the insertion direction D. A diameter of a part of each positioning member 30A between the second positioning surface 36A and the second limiting surface 38A, which is the diameter H3 of each shank 322A, is smaller than the diameter H4 of each through hole 26A. In this way, the floating plate 22A having the through holes 26A could move freely relative to the outer cover 10A and the positioning members 30A fixed to the outer cover 10A in multiple directions, which are perpendicular to the insertion direction D, within a range of a space between the diameter H3 of the shank 322A and the diameter H4 of the through hole 26A. In other words, the outer cover 10A could also move freely relative to the floating plate 22A in multiple directions, which are perpendicular to the insertion direction D, within the range of the space between the diameter H3 of the shank 322A and the diameter H4 of the through hole 26A.

The pump 40A is combined with the pump base 24A of the pump support 20A. Specifically, the pump 40A is combined with the supporting plate 242A of the pump support 20A. One side of the pump 40A facing the insertion direction D has two quick plugs 42A, wherein one of the quick plugs 42A is used to introduce a fluid into the pump 40A, and the other quick plug 42A is used to output the fluid from the pump 40A.

Referring to FIG. 9 to FIG. 12, when the second embodiment of the present disclosure is used, the user holds the handle 19A on the outer cover 10A and inserts the hot swappable pump device 100A into a slot of a housing. The two quick plugs 42A of the pump 40A are aligned with a quick socket of a water cooling system inside the housing. The two quick plugs 42A are inserted into the quick socket of the water cooling system along the insertion direction D, concatenating the pump 40A to the water cooling system inside the housing to drive a liquid within the water cooling system to flow. When a relative position between the slot of the housing, into which the hot swappable pump device 100A is inserted, and the quick socket inside the housing does not match with a relative position between the two quick plugs 42A of the hot swappable pump device 100A and the outer cover 10A, the position of the outer cover 10A relative to the pump 40A could be adjusted by the design that the outer cover 10A could move relative to the floating plate 22A. This adjustment allows the outer cover 10A to smoothly insert into the slot of the housing, preventing a situation where the outer cover 10A could not be placed into the slot of the housing.

In the second embodiment of the present disclosure, three fastening holes 16A are disposed at the outer cover 10A, three through holes 26A are disposed at the floating plate 22A in correspondence to the positions of the three fastening holes 16, and three positioning members 30A are disposed in correspondence to the three fastening holes 16A and the three through holes 26A. In other embodiments, either two or four fastening holes 16A could be disposed around the outer cover 10A, two or four through holes 26A, which correspond to positions of the two fastening holes 16A or positions of the four fastening holes 16A, are disposed at the floating plate 22A, and two or four positioning members 30A are disposed to correspond to the number of the fastening holes 16A and the number of the through holes 26A; a way of passing each positioning member 30A through each through hole 26A and combining each positioning member 30A with each fastening hole 16A is the same as the positioning member 30 described in the first embodiment. In addition to screwing the rod 321A of each positioning member 30A into each fastening hole 16A as described in the second embodiment, the positioning member could also be designed as a pin, wherein the positioning member also has a rod, a shank, and the head that are sequentially connected; the rod is inserted into a fastening hole, which is a straight hole, in a tight-fitting manner for fixation; similarly, the second positioning surface and the second limiting surface are also disposed on the positioning member.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A hot swappable pump device, comprising:

an outer cover with an inner surface, wherein a normal direction of the inner surface is defined as an insertion direction; at least two fastening holes are disposed on a periphery of the inner surface, wherein a peripheral edge of an end of each of the at least two fastening holes facing the insertion direction has a first positioning surface;

a pump support comprising a floating plate and a pump base connected to the floating plate, wherein the floating plate abuts against the inner surface of the outer cover; the floating plate is provided with at least two through holes corresponding to the at least two fastening holes; a peripheral edge of an end of each of the at least two through holes facing the insertion direction has a first limiting surface;

at least two positioning members respectively having a rod, a second positioning surface, and a second limiting surface in sequence along the insertion direction, wherein each of the at least two positioning members passes through each of the at least two through holes and is combined with each of the at least two fastening holes with the rod; the second positioning surface abuts against the first positioning surface, and the second limiting surface is adjacent to the first limiting surface; a diameter of a part of each of the at least two positioning members located between the second positioning surface and the second limiting surface is smaller than a diameter of each of the at least two through holes; and a pump combined with the pump base of the pump support, wherein one side of the pump facing the insertion direction has two quick plugs.

2. The hot swappable pump device as claimed in claim 1, wherein the pump base comprises a rear plate and a supporting plate connected to the rear plate; the rear plate is combined with the floating plate, and the pump is combined with the supporting plate.

3. The hot swappable pump device as claimed in claim 1, wherein the pump base is a plate and is integrally connected to the floating plate.

4. The hot swappable pump device as claimed in claim 1, wherein each of the at least two fastening holes is a screw hole; the rod of each of the at least two positioning members is a threaded rod and is screwed into each of the at least two fastening holes; at least one of the at least two positioning members comprises a bolt and a collar; the bolt comprises the rod and, in sequence along the insertion direction starting from the rod, a shank and a head that are sequentially connected; the collar sleeves the shank of the bolt; an outer diameter of the collar is smaller than the diameter of each of the at least two through holes; the collar has a flange around a portion of the collar adjacent to the head, wherein the flange abuts against the head; the second positioning surface is disposed on an end edge of the collar adjacent to the rod, and the second limiting surface is formed on one side of the flange opposite to the insertion direction.

5. The hot swappable pump device as claimed in claim 4, wherein the inner surface is a rectangular plane with four corners; the at least two fastening holes are respectively disposed on at least two of the four corners of the inner surface; the floating plate abuts against a middle of the inner surface.

6. The hot swappable pump device as claimed in claim 5, wherein the floating plate is a rectangular plate with four corner sections around the floating plate; one side of at least one of the four corner sections facing the insertion direction forms a recess in correspondence to the number of the collar; a sidewall is provided around the recess; one of the at least two through holes that is corresponding penetrates the recess; the flange of the collar is accommodated within the recess, and a space is disposed between the flange and the sidewall.

7. The hot swappable pump device as claimed in claim 6, wherein the floating plate has a peripheral surface; one side of the recess adjacent to the peripheral surface has an opening; two opposite sides of the peripheral surface adjacent to the opening have two elastic sheet seats; two elastic sheets are respectively combined with the two elastic sheet seats; two free ends of the two elastic sheets extend toward the opening and contact two sides of the flange.

8. The hot swappable pump device as claimed in claim 7, wherein a side of the outer cover opposite to the inner surface has an outer surface, and a handle is combined with the outer surface.

9. The hot swappable pump device as claimed in claim 1, wherein each of the at least two fastening holes is a screw hole; at least one of the at least two positioning members is a bolt and comprises the rod and, in sequence along the insertion direction starting from the rod, a shank and a head that are sequentially connected; the rod is a threaded rod and is screwed into one of the at least two screw holes; a diameter of the shank is larger than a diameter of the rod, and a diameter of the head is larger than the diameter of each of the at least two through holes; the second positioning surface is disposed on an end edge of the shank adjacent to the rod, and the second limiting surface is formed on one side of the head opposite to the insertion direction; the shank is located between the second positioning surface and the second limiting surface.

10. The hot swappable pump device as claimed in claim 9, wherein a side of the outer cover opposite to the inner surface has an outer surface, and a handle is combined with the outer surface.

* * * * *